US005709320A

United States Patent [19]

Jimenez

[11] Patent Number: 5,709,320

[45] Date of Patent: Jan. 20, 1998

[54] MANUAL SELF-DEFENSE SPRAY DEVICE

[76] Inventor: Ruben Jimenez, 1038 Woolworth St., Houston, Tex. 77020

[21] Appl. No.: 688,532

[22] Filed: Jul. 30, 1996

[51] Int. Cl.[6] ..... B67D 5/64

[52] U.S. Cl. ..... 222/175; 222/153.13; 222/183; 222/340; 222/386

[58] Field of Search ..... 222/3, 78, 79, 222/175, 192, 153.11, 153.13, 183, 340, 386; 42/1.08; 739/154

[56] References Cited

U.S. PATENT DOCUMENTS

| | | | |
|---|---|---|---|
| 1,253,917 | 1/1918 | Wern | 222/340 |
| 1,299,078 | 4/1919 | Weiss | 222/386 |
| 3,353,749 | 11/1967 | Lahaug | 222/78 |
| 4,061,249 | 12/1977 | Smith | 222/78 |
| 4,135,645 | 1/1979 | Kimmell | 222/78 |
| 4,446,990 | 5/1984 | Stevenson et al. | 222/82 |
| 5,373,427 | 12/1994 | McLean | 362/96 |
| 5,476,192 | 12/1995 | Julinot | 222/78 |

*Primary Examiner*—Philippe Derakshani
*Attorney, Agent, or Firm*—Gunn & Associates, P.C.

[57] ABSTRACT

A holder for a self defense spray comprises primarily a canister to hold a quantity of a self defense spray with an attached ring extending from the canister which fits a human finger. On top of and extending from the canister is an actuating plunger for ready access by a human thumb. The canister also has an orifice to discharge self defense spray upon actuation of the actuating plunger. Alternatively, the canister may form a hollow, open-topped cylinder to receive a pressurized can, such as an aerosol can of the self-defense spray, with the same or similar ring for use by the person carrying the spray. The actuator may be oriented to extend beyond the perimeter of the cylindrical canister to make the actuator more readily accessible by the user.

10 Claims, 1 Drawing Sheet

FIG. 1a
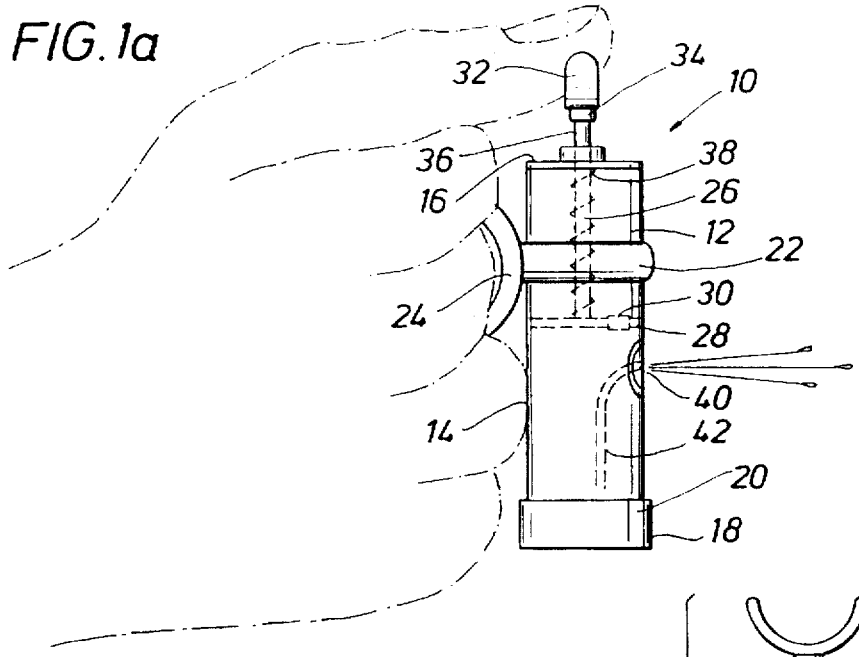
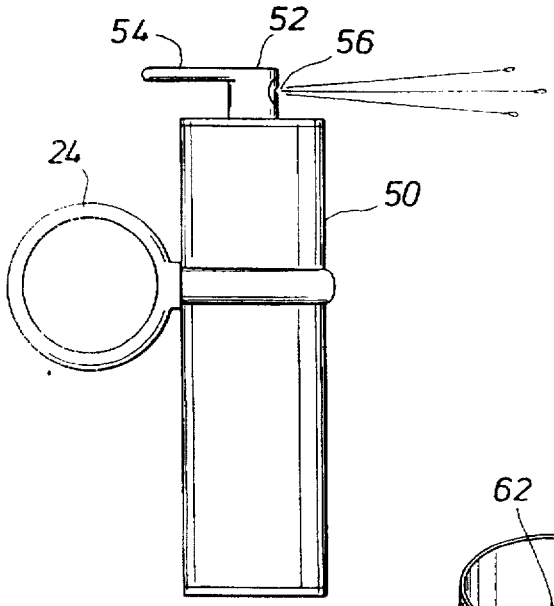
FIG. 2
FIG. 1b
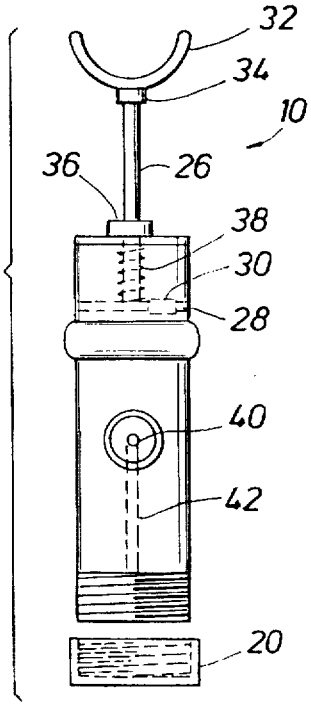
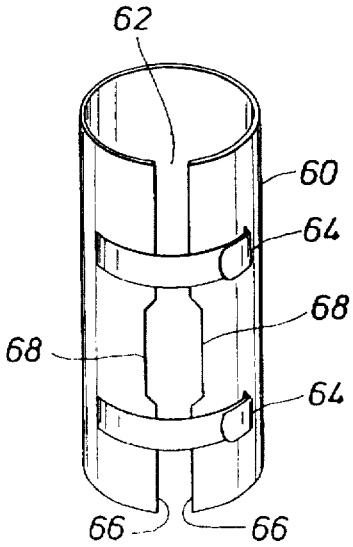
FIG. 3

MANUAL SELF-DEFENSE SPRAY DEVICE

FIELD OF THE INVENTION

The present invention relates generally to the field of personal self-defense devices and, more particularly, to a holder for retaining a repellent spray to ward off a personal attack or assault.

BACKGROUND OF THE INVENTION

Individuals often find themselves alone and in a situation in which they are vulnerable to assault. For example, people who work late in the evening and then must walk to their privately owned vehicles, or wait for public transportation, may find themselves the target of a thief, mugger or rapist. Others regularly must go into high crime areas in the normal course of their jobs.

For example, the incidence of crime against mail carriers in high crime areas has recently seen a significant increase. An increasingly common mode of operation for certain thieves involves lying in wait for a mail carrier to approach a mail box area for an apartment complex and, when the mail carrier is busy with his duties distributing the mail to the various mail boxes and his attention is diverted, the thief will strike. Although the mail carrier is usually provided with a canister of pepper spray or some other repellent such as mace, the self-defense spray is most commonly carried in the mail bag of the carrier and is not immediately accessible. While the mail carrier gropes in his bag for the self-defense spray, the thief can immobilize or even kill the carrier and make off with the mail.

A similar situation is presented when someone, particularly a woman, must walk through a parking lot or garage to get to a vehicle in a poorly lighted area. Today, especially brazen attackers may even strike in broad daylight. Many women carry mace or other self-defense devices in their purses but this precaution does little good if the attacker strikes before she can retrieve the device from her purse.

Thus, there remains a need for a simple and effective holder for keeping a self-defense gadget readily at hand. Such a holder should be simple and not interfere with the normal activities of the user. Further, such a device should be inexpensive and unobtrusive so that the user is encouraged and confident in its use. Finally, such a holder should be secure in that it is unlikely to be made ineffective by dropping it or finding that it is unavailable just when it is needed the most.

SUMMARY OF THE INVENTION

The present invention provides just these features and objects and solves the drawbacks of the prior art through a simple yet effective manual holder for a self-defense spray. In a preferred embodiment, a substantially cylindrical canister retains a precharged spray can. Attached to or integrally formed with the canister is a ring, which fits easily and securely over a finger of a user. A readily accessible actuator is also provided adjacent the user's thumb so that the user can activate the self-defense spray easily and consciously.

The canister is sized to accept a standard spray can, such as that provided to many postal carriers, or those manufactured and sold by various companies. Alternatively, the canister may be formed of an incomplete cylinder with closure latches that can accommodate a range of spray can sizes.

In another preferred embodiment, the canister itself serves as the reservoir for the repellent spray. In this embodiment, the repellent spray may be dispensed by pump action of the thumb actuator or the canister can be charged with a compressed gas, such as carbon dioxide. This embodiment may be made totally disposable, or it can be made to be recharged after use.

These and other features of the present invention will be apparent to those of skill in the art from a review of the following detailed description along with the accompanying drawings.

BRIEF DESCRIPTION OF THE DRAWINGS

FIG. 1*a* is side view of the holder for a self-defense spray in accordance with the present invention, shown in use with a pump-action embodiment.

FIG. 1*b* is a front view of the holder of FIG. 1*a*.

FIG. 2 is a side view of the holder of the present invention in a pressurized propellant embodiment.

FIG. 3 is a front view of an adjustable canister that forms a part of the present invention to accommodate a variety of sizes of propellant driven spray cans.

DETAILED DESCRIPTION OF A PREFERRED EMBODIMENT

FIG. 1*a* depicts a pump-action self-defense spray holder 10 of the present invention. The holder 10 comprises an enclosed canister 12 including a cylindrical body 14 with a top wall 16 and a bottom wall 18. As shown in FIGS. 1*a* and 1*b*, the bottom wall 18 may be formed as a removable cap 20, or it may be integrally formed with the cylindrical body 14.

Around the canister 12 is a mounting sleeve 22, which may slide onto the canister 12, or which may be formed as an integral part of the cylindrical body 14. Contiguous with the sleeve 22 (or the cylindrical body 14) is a ring 24. The ring 24 preferably comes in a variety of ring sizes to comfortably yet securely fit the user, as desired. The ring should fit a finger of the user so as to feel firm, but not so as to interfere with normal activities of the hand of the user on which the holder 10 is in use. Further, the ring and the sleeve may be molded as a single piece construction, or the ring and the canister may be molded as a single piece construction.

The holder 10 further includes a plunger 26, in the embodiment illustrated in FIGS. 1*a* and 1*b*. At one end of the plunger 26 is a piston 28, and through the piston 28 is a check valve 30. The check valve 30 permits air to be admitted below the piston 28 and above the level of the liquid repellent within the canister 12 on the upstroke of the plunger 26, and it seals off on the down stroke of the plunger to create pressure on top of the liquid repellent to force the liquid out of the canister.

At the other end of the plunger is a thumb rest 32. The thumb rest 32 is easily and comfortably accessible to the thumb of the user. The thumb rest 32 also includes a locking hub 34, which fits into a receiver 36 on the top wall 16. Together, the locking hub 34 and the receiver 36 preferably comprise a bayonet type or other type lock to lock down the plunger so that repellent is not expelled from the canister inadvertently. Beneath the top 16 is a tension spring 38 to return the plunger to the vertically extended position; alternatively, a compression spring may be located between the thumb rest 32 and the top 16.

The canister 12 also includes a discharge orifice 40 to expel the liquid repellent under pressure within the canister. The orifice 40 is in fluid communication with a duct 42, which terminates at its lower end near the top surface of the bottom wall 18. This ensures that the maximum amount of the repellent is available for discharge from the self-defense device. The location of the duct 42 in FIG. 1*a* is exaggerated so that it can be seen, but those of skill in the art will appreciate that the duct should be positioned adjacent the interior wall of the canister 12 so that it does not interfere with the full travel of the piston 28 to expel as much fluid from the device as possible.

FIG. 2 depicts another preferred embodiment of the present invention. In this embodiment, the repellent spray is discharged from the device under pressure from a gas within a canister 50. The device includes the sleeve 22 and the ring 24 as previously described. In this case, the sleeve 22 may surround a manufacturers supplied pressurized canister 50, or the sleeve 22 may be formed with or attached to a cylinder into which the pressurized canister is positioned. On top of the canister 50 is a thumb actuator 52 which includes an extender 54 to permit easy thumb access for actuation of the spray. The actuator may be oriented to extend beyond the perimeter of the cylindrical canister to make the actuator more readily accessible by the user. In this embodiment, a spray orifice 56 is included in the thumb actuator 52.

FIG. 3 depicts an open cylinder 60 to take the place of the cylinder of FIG. 2, to permit the adaptation of the present invention to a variety of sizes of supplied, pressurized canisters. The open cylinder 60 is also adaptable to the configuration of the holder of FIGS. 1*a* and 1*b*. The term "open cylinder" refers to the fact that the cylinder 60 includes a gap 62 which may be expanded by a pair of lever action, adjustable clips 64. The open cylinder 60 includes mutually opposed edges 66, and the edges may even be made to overlap to accommodate particularly small diameter canisters. The edges 66 also include openings 68, which permit the exposure of the orifice 40, if the open cylinder is used in conjunction with the embodiment of FIGS. 1*a* and 1*b*.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A holder for a self defense spray comprising:

a. a canister to hold a quantity of a self defense sprays, wherein the canister defines an elongated cylinder with a top wall and a bottom wall;

b. a ring extending from the canister, the ring of a size to fit a human finger;

c. an actuating plunger extending from the canister, the plunger positioned for ready access by a human thumb;

d. an orifice in the canister to discharge self defense spray from canister upon actuation of the actuating plunger; and;

e. a duct between the orifice and a point adjacent the bottom wall.

2. The holder of claim 1 wherein the canister and the ring are molded as a single piece construction.

3. The holder of claim 1 further comprising a sleeve around the canister and adjoining the ring.

4. The holder of claim 3 wherein the sleeve and the ring are formed in a single molding.

5. The holder of claim 1, further comprising a locking mechanism between the plunger and the top wall to prevent the inadvertent discharge of spray from the canister.

6. The holder of claim 1 further comprising a piston coupled to the plunger and within the canister.

7. A holder for a self defense spray comprising:

a. a canister to hold a pressurized can of a self defense spray, the canister comprising i. an open cylinder with a gap between mutually opposed edges; and ii. an adjustable latch to hold the mutually opposed edges in stationary relationship to each other;

b. a ring extending from the canister, the ring of a size to fit a human finger; and c. an actuator extending from the pressurized can, the actuator positioned for ready access by a human thumb.

8. The holder of claim 7, wherein the canister and the ring are molded as a single piece construction.

9. The holder of claim 8 further comprising a sleeve around the canister and adjoining the ring.

10. The holder of claim 9 wherein the sleeve and the ring are formed in a single molding.

* * * * *